US006846277B2

(12) United States Patent
Lehner-Dittenberger

(10) Patent No.: US 6,846,277 B2
(45) Date of Patent: Jan. 25, 2005

(54) ROLLER FOR WINDING UP A MATERIAL WEB

(75) Inventor: Stefan Lehner-Dittenberger, Wilhelmsburg (AT)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 10/062,832

(22) Filed: Jan. 31, 2002

(65) Prior Publication Data

US 2002/0103063 A1 Aug. 1, 2002

(30) Foreign Application Priority Data

Jan. 31, 2001 (DE) ..... 101 04 195

(51) Int. Cl.[7] ..... B25F 5/02; F16C 13/00

(52) U.S. Cl. ..... 492/42; 492/56; 492/40; 492/39; 29/895.21

(58) Field of Search ..... 492/42, 40, 39, 492/7, 6, 56, 20, 16, 45, 47; 100/162 B; 29/895.21, 895.22; 226/152, 189, 190

(56) References Cited

U.S. PATENT DOCUMENTS

| | | | | |
|---|---|---|---|---|
| 619,496 A | | 2/1899 | Munsey | 492/45 |
| 2,450,727 A | | 10/1948 | Haushalter | 29/895.21 |
| 2,741,014 A | | 4/1956 | Hubbard | 492/56 |
| 3,019,511 A | | 2/1962 | Hornbostel | 492/6 |
| 3,522,643 A | | 8/1970 | Winkler | 492/6 |
| 3,750,246 A | | 8/1973 | Pessen | 492/6 |
| 4,453,299 A | | 6/1984 | Hemmi | 492/7 |
| 4,620,348 A | | 11/1986 | Guttinger | 492/7 |
| 4,741,079 A | | 5/1988 | Quehen | 492/15 |
| 4,821,384 A | | 4/1989 | Arav | 492/7 |
| 4,864,343 A | * | 9/1989 | Nelson | 100/162 B |
| 4,974,782 A | * | 12/1990 | Nelson | 100/162 B |
| 5,092,235 A | | 3/1992 | Rise | 100/168 |
| 5,265,812 A | | 11/1993 | Holopainen et al. | 242/68.5 |
| 5,803,398 A | | 9/1998 | May et al. | 242/547 |
| 5,967,450 A | | 10/1999 | May et al. | 242/547 |
| 6,042,048 A | | 3/2000 | Czuprynski et al. | 242/613 |
| 6,056,230 A | | 5/2000 | Peters et al. | 242/541.5 |
| 6,409,644 B1 | | 6/2002 | Van Haag | 492/7 |

FOREIGN PATENT DOCUMENTS

| | | | |
|---|---|---|---|
| DE | 22 11 892 B2 | 2/1978 | F16C/13/00 |
| DE | 23 16 746 B2 | 8/1978 | F16C/13/00 |
| DE | 80 33 212.3 | 5/1984 | B65H/75/24 |
| DE | 37 03 563 A1 | 8/1987 | D21F/1/36 |
| DE | 29622141 | 3/1997 | B65H/75/10 |
| DE | 197 29 907 A1 | 1/1999 | F16C/13/00 |
| DE | 29907795 | 9/1999 | B65H/18/26 |
| DE | 10036951 | 2/2002 | B65H/75/10 |
| EP | 0 500 515 B1 | 5/1997 | B65H/75/10 |
| EP | 0784227 | 7/1997 | G03B/17/26 |

* cited by examiner

*Primary Examiner*—Marc Jimenez
(74) *Attorney, Agent, or Firm*—Taylor & Aust, P.C.

(57) ABSTRACT

In a roller enveloping a base body for winding up a material web, particularly a paper web, the circumferential surface contacted by the winding material is more radially resilient near the two roller ends than in the mid-roller area, compensating, at least partially, for a deflection of the base body at the maximum winding diameter. This increased radial resilience near the two roller ends is due to an appropriate resilient layer applied on at least sections of the base body and/or at least one appropriate resilient element placed on the base body.

24 Claims, 3 Drawing Sheets

ROLLER FOR WINDING UP A MATERIAL WEB

BACKGROUND OF THE INVENTION

1. Field of the Invention

The invention concerns a roller or a reel spool for winding up a material web, especially of paper.

2. Description of the Related Art

In state-of-the-art spool designs, large roller diameters and bearings, which are positioned at large distances from each other, cause a significant bending of the reel spool core that tends to cause the ends to incline. Such inclination results in a shifting in the layers of the winding material, which causes shiners to develop. The higher marginal pressure in the paper layers creates a bending stress within the winding material, which in turn leads to shear stress between the paper layers that can cause relative shifting. This bending phenomenon thus constitutes the actual dimensioning criterion for such reel spools. As such, the wall thickness and diameter, and consequently weight and cost, of such a reel spool are determined by a relatively small marginal area.

The design of a winding tube known from EP-B-0 500 515 includes a double-walled tube construction with two support bearings. This design affects the bending line of the outer tube in such a way that the outer tube's edge is kept straight or its inclination is minimized. Likewise, a roller described in DE-B-22 11 892 is designed as a 2-body roller. In this design, the inner body is made up of a solid or massive roller core. Here, a straight external mantle tube surface is achieved by giving a conical shape to the core, onto which the tube is pressed as the load increases. At the edge, the tube may be supported hydraulically or pneumatically.

Another type of elastic roll, known from DE-S-23 16 746, for pressure treatment of winding material, envisages a multi-part roller tube/roller core design in which the tube is made of a thermoplastic material. A torsion-resistant but longitudinally movable support of the tube's marginal areas serves to compensate expansion at higher differential temperatures due to different coefficients of thermal expansion. In DE-A-197 29 907, a roller with a 2-body roller core design is described in which the center of the tube is supported by the core, and the wall thickness tapers off toward the edges. The objective here is not to compensate for the global bending of the roller core, but to attain the most constant possible curvature of the roller tube's bending line in order to achieve a spreading effect.

From DE-A-37 03 563, a stretch roller or similar device for paper machine sheets is known and features a double-walled roller design, in which the center of the fiber-reinforced plastic outer tube is supported by the inner metal tube. Here, too, the objective is to achieve a spreading effect, not compensation for the global bending of the inner tube.

SUMMARY OF THE INVENTION

The present invention is related to an improved roller or reel spool in which the global deflection of the roller body is compensated, at least partially, and the deflection of the roller surface line is reduced accordingly.

This goal is achieved, according to the invention, by a roller for winding up a material web, especially of paper, with a base body and a web-contacting surface. The area of the two roller ends features a radial flexibility that is higher than in the center of the roller. This flexibility is due to a resilient layer, which is attached to segments of the contacting surface, and/or due to at least one resilient element, which is attached to the base body. The resilient member (i.e., resilient layer and/or element) compensates, at least in part, for a deflection of the base body that occurs at maximum winding diameter.

Due to this design, deflection of the material of the base body is reduced at least to an extent sufficient to prevent major marginal inclination even at lager winding diameters and wider bearing distances. At the same time this design avoids the shifting of layers within the winding material that leads to the development of shiners. The compensation becomes effective in the surface area of the roller base body, attaining, in principle, a Winkler-type bedding. Since the reel spool's dimensions are no longer determined by its vertical deflection or marginal inclination, once the material parameters have been appropriately adjusted, weight is significantly reduced. The lower weight of the reel spool or roller also results in a correspondingly lower load on lifting and transporting devices. The additional cost is minimal. Reel spools already in use can simply be modified appropriately. There is no need to make new ones. Due to the weight reduction, it will not be necessary to adjust the lifting, transporting and/or rotating machinery.

The radial thickness of the layer or element, as viewed parallel to the roller axis, may vary. Alternatively or additionally, radial rigidity of the respective layer or elements, as viewed parallel to the roller axis, may also vary. In certain cases it is advantageous to include, preferably in the central area of the roller, at least one particularly rigid point of support in whose vicinity the radial flexibility of the circumferential surface contacting the web is accordingly lower than in the area of the two ends of the roller. For a useful and practical implementation, several, particularly rigid points of support are envisaged, spaced from each other in an axial direction, and in whose vicinity the radial flexibility of the circumferential surface contacting the web is accordingly lower than in the area of the two ends of the roller. Preferably, at least one rigid point of support will be, at least partially, formed by the base body itself.

The circumferential surface contacting the web is an appropriate tube enveloping the base body, in particular a resilient tube. In such a tube, the resilient layer or the resilient element is positioned radially between the base body and the tube. The advantageously resilient tube particularly serves the purpose of equalizing the surface of the roller or reel spool. It may be made of metal, or it could also be formed of a rubber coating or a similar material. This tube would also have to be taken into account when determining the dimensions of the resilient layer or of the resilient elements. Thus, in contrast to known roller types, this is not a supporting tube exposed to a bending load.

In an advantageous embodiment of the roller according to this invention, a resilient layer is attached to the base body, at least in the area of the two ends of the roller. This resilient layer features a constant radial rigidity over its entire axial length, and its general thickness increases toward each end of the roller. In this arrangement, the thickness of the resilient layer may increase toward each of the roller ends, essentially proportionately to the inclination of the base body occurring at maximum winding diameter. Preferably, the base body tapers off toward each of the roller ends, essentially in proportion to the increasing thickness of the resilient layer.

In this process, provided there is a compressible layer, a deformed marginal area of smaller diameter develops through surface compression of the resilient layer, resulting in a loosening of the innermost layers in the marginal areas of the roller or reel spool's lower area, which, in turn, facilitates the escape of air. Radial tension, on the other hand, is lost. The goal must be to keep the diameter constant and not just to partially compensate the deflection.

Advantageously, a rubber-elastic layer formed of rubber or other elastomeric material may be provisioned to serve as a resilient layer. Optionally, the resilient layer may be formed by a particular non-homogenous layer of foamed material and/or honeycomb structure, etc. In a useful and practical embodiment, the resilient (preferably rubber-elastic) layer, which is provided at least in the area of the two roller ends, is placed between the base body and the resilient tube, which is made, at least in part, of a rubber coating or the like.

According to another advantageous embodiment of the roller, according to the invention, a resilient layer is attached to the base body, at least in the area of the two roller ends. In this embodiment the resilient layer features a constant thickness over its entire axial length, and its radial flexibility generally increases toward each end of the roller. The resilient layer may, therefore, possess over its axial length, a particularly variable E-modulus. In most cases, however, it should be simpler to provide discrete resilient elements such as discrete spring elements, for example.

Accordingly, another advantageous embodiment of the roller, according to the invention, includes several resilient elements, serving the purpose of generating a higher flexibility within the web-contacting circumferential surface in the area of the two roller ends relative to the central area of the roller. The distances between these elements are selected accordingly, and/or their flexibility is varied accordingly. In this design, the resilient elements may each be, at least partially, embodied as discrete spring elements. Rubber-elastic ring-shaped bodies and/or spring packets extending over the circumference of the base body may, for example, serve as discrete spring elements. The resilient elements may, at least partially, be pre-stressed. Further, for the equalization of the web-contacting circumferential surface, preferably resilient tube may be sleeved over. As a weight-saving measure, the base body is preferably designed as a hollow body.

According to another advantageous embodiment of the roller, according to the invention, at least two, preferably symmetrical tension anchors are attached in the area of the resilient layer, which is at least partly attached to the base body, and/or in the area of the corresponding resilient element that is attached to the base body. The advantage here is that the deflection of the surface line of the roller is further reduced, due to the relations of forces and their distribution. Such tension anchors are well known to experts in the field and are already used in many practical applications. The tension anchors may be arranged, according to prevailing stress conditions, parallel and/or nearly parallel to the axis of the base body or may be positioned diagonally and/or spirally relative to the base body. Furthermore, the tension anchors are advantageously braced at the roller's front side via at least two outer walls, whereby the tension anchors may be braced diagonally or perpendicularly, relative thereto. For optimal functionality, the tension anchors are held in their radial position relative to the roller by at least one disc spacer.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Figure 1:
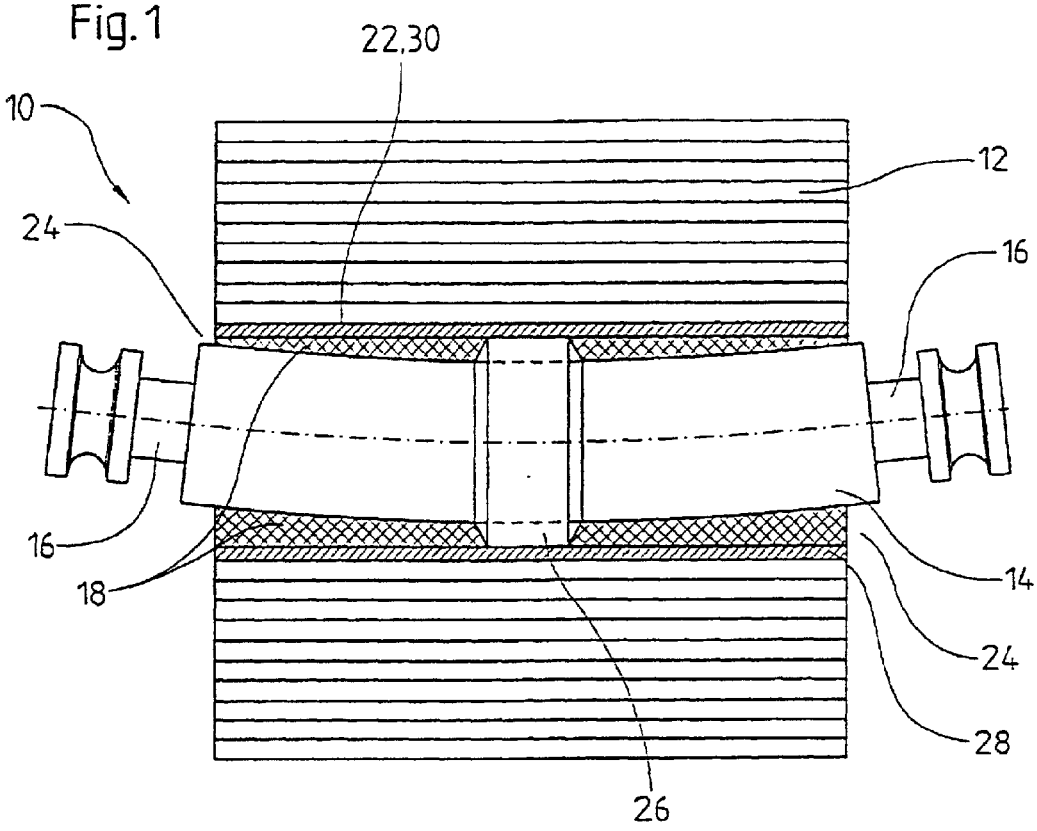
FIG. 1 is a schematic, partially sectional representation of a first embodiment of roller of the present invention for winding a material web, the roller having a resilient layer attached to the base body and having a point of support of higher rigidity in the central area of the roller.

Corresponding reference characters indicate corresponding parts throughout the several views. The exemplifications set out herein illustrate at least one preferred embodiment of the invention, in one form, and such exemplifications are not to be construed as limiting the scope of the invention in any manner.

DETAILED DESCRIPTION OF THE INVENTION

FIGS. 1 to 6 show different embodiments of roller 10 for winding up material web 12, which may particularly be a paper web. Roller 10 in each case features base body 14, which revolves, e.g., on journals 16 protruding into its ends.

By virtue of resilient layer 18 applied at least on sections of base body 14 and/or by virtue of at least one suitable resilient element 20 arranged on base body 14, envelope or circumferential surface 22 contacting winding material web 12 is more radially yielding/less rigid nearer roller ends 24, 24', than in the middle of roller 10, in order to at least partially compensate for the deflection of base body 14 when winding material web 12 is thickest. The radial thickness and/or radial rigidity of resilient layer 18 or elements 20 may vary along the length of roller 10.

FIG. 1 shows, in schematic, a partial sectional representation of roller 10 with resilient layer 18 applied on base body 14 and a more rigid support point 26 provisioned in the mid-roller area. Circumferential surface 22, contacted by web 12, is, accordingly, less radially resilient in the vicinity of support point 26 than near roller ends 24, 24'. In this case, a particularly resilient tube 28, surrounding base body 14, constitutes circumferential surface 22. Tube 28 is supported in the mid-roller area directly by more rigid support point 26. Resilient layer 18 is positioned in the remaining space between tube 28 and base body 14. Resultingly, as can be seen in FIG. 1, the global deflection of base body 14, at maximal winding material diameter, is at least partially compensated, resulting in an essentially horizontal surface line 30.

Figure 2:
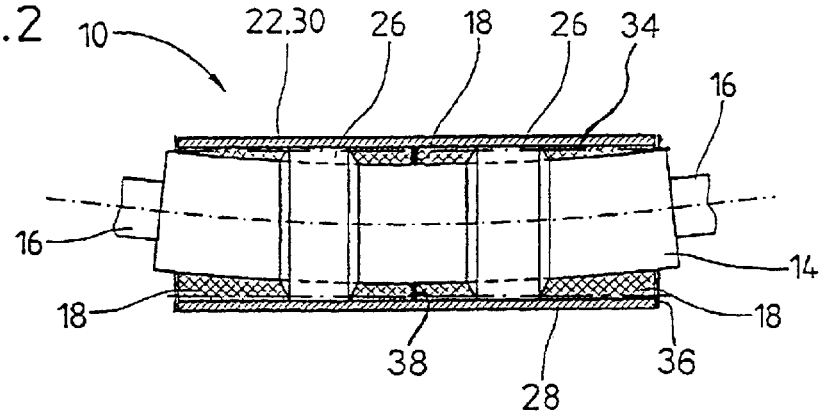
FIG. 2 is a schematic, partially sectional representation of another roller embodiment, the roller having two separate points of support distanced from each other in an axial direction.

Likewise, in the embodiment shown in FIG. 2, resilient layer 18 is again designed to be between a particularly resilient tube 30 and base body 14. In this case, two or more rigid (advantageously completely rigid) support points 26, which are axially distanced from each other, are employed. The remaining space between tube 30 and base body 14 is again filled by elastic layer 18 or by elastic elements 20 serving the same purpose. There are at least two preferably symmetrically arranged tension anchors 34 (indicated only symbolically in dashed lines) attached in the area of resilient layer 18, which is applied at least in sections on base body 14. Tension anchors 34 may be dependent on the embodiment and prevailing stress conditions, attached parallel or nearly parallel to the axis of base body 14 or mounted diagonally or spirally relative to base body 14. Tension anchors 34 are braced at the front side of roller 10 by at least two outer walls 35 (indicated only symbolically in dashed lines), preferably diagonally or in a rectangular manner. In radial direction to roller 10, tension anchors 34 are held in position by at least one disc spacer 38. If at least two disc spacers 38 are used, these may be arranged to suit different prevailing stress conditions.

Likewise, in the embodiment shown in FIG. 3, base body 14 is again enveloped by a particularly resilient tube 28. In this case, again, a relatively rigid support point 26 is provided in the mid-roller area. In this case, between the middle roller area and each of roller ends 24, 24', two elastic elements 20 are positioned, axially distanced from each other, between tube 28 and base body 14. Elastic elements 20 may be made of rubber or another elastomeric material, for example, or they may be springs, e.g., steel springs. For example, rubber-elastic ring-shaped bodies or spring packets extending over the circumference of base body 14 or similar may be used as elastic elements 20. In the vicinity of at least corresponding resilient element 20, positioned on base body 14, at least two preferably symmetrically arranged tension anchors 34 (indicated only symbolically with broken lines) are attached.

Figure 3:
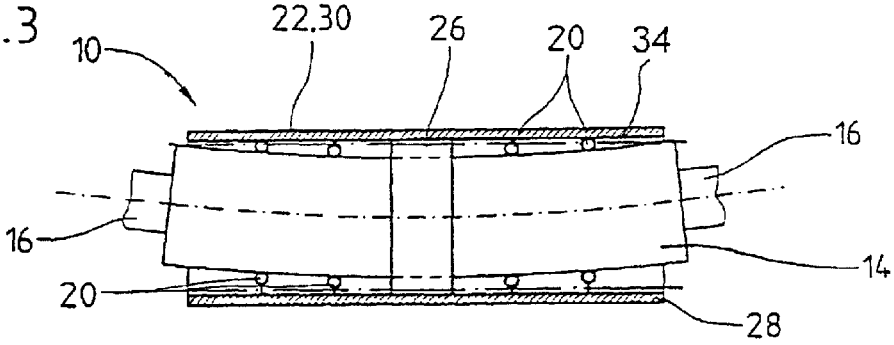
FIG. 3 is a schematic, partially sectional representation of another roller embodiment, the roller including several resilient elements distanced from each other in an axial direction.

FIGS. 1–3 illustrate that support point 26 is a ring 26 placed over base body 14. As discussed above ring 26 is rigid and is in contact with base body 14 and resilient tube 30, thereby partially supporting resilient tube 30.

Figure 4:
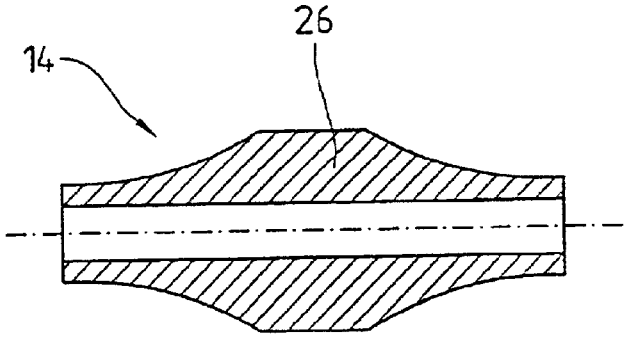
FIG. 4 is a schematic, partially sectional representation of another possible roller base body embodiment, the cross-section thereof reducing toward the ends thereof.

FIG. 4 shows in schematic, a partial sectional representation of a possible embodiment of roller base body 14 having a cross-section that tapers off toward ends 24, 24'. Thus, in the mid-roller area, a particular support point 26 may be formed again in whose vicinity the circumferential surface area contacted by winding web material 12 is again less radially resilient or more rigid than near roller ends 24, 24'.

On the sections of base body 14, which taper off toward roller ends 24, 24', resilient layer 18 of correspondingly varying radial thickness, for example, or discrete elastic elements 20 of correspondingly varying thickness, for example, may be attached. Even if resilient layer 18 or elements 20 are of equal rigidity, a higher flexibility or lower rigidity of circumferential surface 22 contacted by winding material web 12 is thereby obtained toward end 24, 24' of roller 10.

Figure 5:
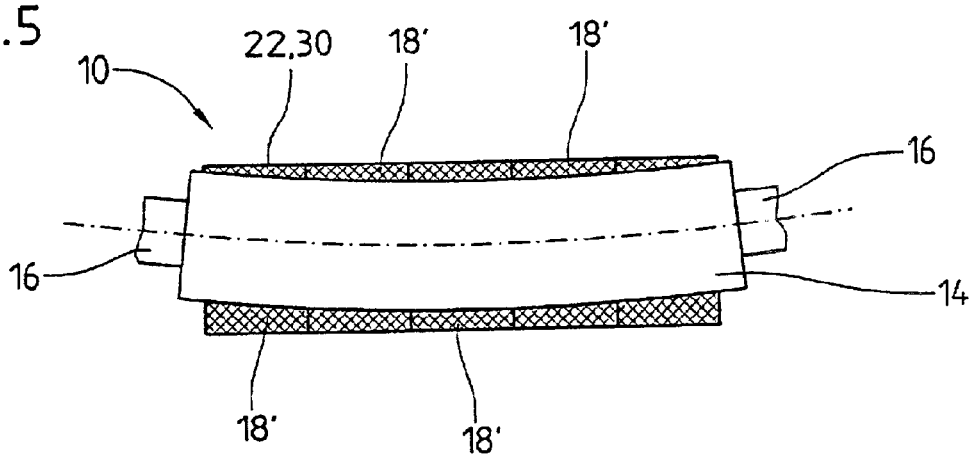
FIG. 5 is a schematic, partially sectional representation of another roller embodiment, the roller having zones of varying rigidity.

FIG. 5 shows, in schematic, a partial sectional representation of another embodiment of roller 10 with sequential zones of different rigidity therealong, which may be formed by appropriate sections 18' of resilient layer 18 or by appropriate different resilient elements 20, for example. In this embodiment, surface 30 contacting winding material web 12 may be made directly of resilient layer 18 or elastic elements 20. No resilient outer tube 28 is, therefore, supplied as part of this embodiment.

Figure 6:
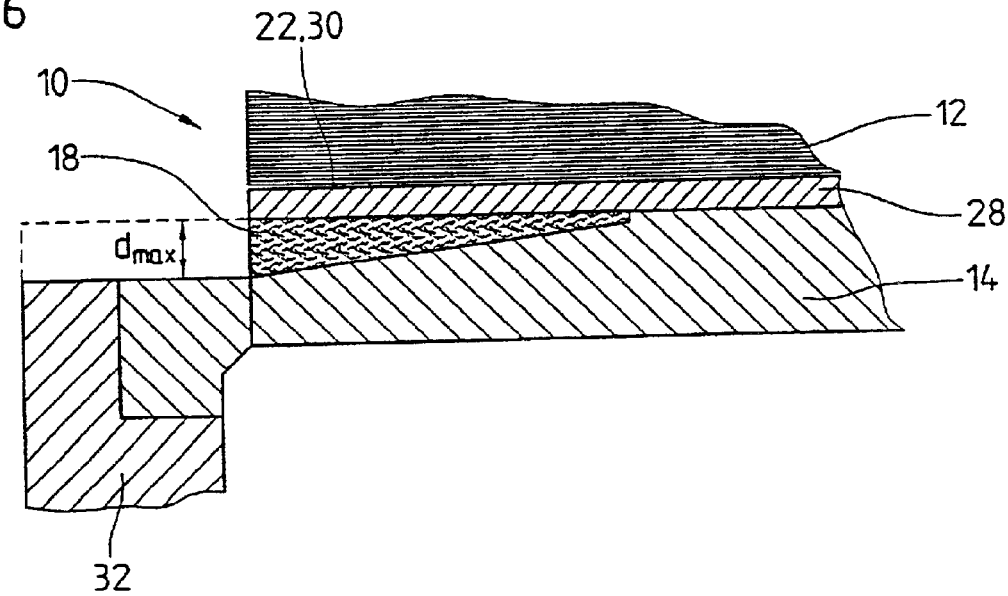
FIG. 6 is a schematic, partially sectional partial representation of another roller embodiment, the roller including a resilient layer whose radial thickness increases toward the roller ends, the resilient layer being applied in the roller end area on the base body between it and a rubber coating.

FIG. 6 shows, in schematic, a partial sectional representation of another embodiment of roller 10. In this embodiment, resilient layer 18 applied on base body 14 near roller ends 24, 24'. In this case, resilient layer 18 is placed near each of roller ends 24, 24' between a sector of base body 14, tapering off toward respective roller end 24, 24', and a resilient outer tube 28 formed here, by way of example, by a rubber coat or a coat of another elastomer. Thus, in this case at least near roller ends 24, 24', resilient layer 18 may be applied on base body 14, which is equally rigid radially over all its axial length and thickens toward roller ends 24, 24'. As can be seen in FIG. 6, the radial thickness of resilient layer 18 is greatest near one of roller ends 24, 24'. Roller 10 may be closed off at both of ends 24, 24' by a lid 32, one of which can be seen in FIG. 6. In general, base body 14 can be designed as a hollow body. It may be made of steel, for example.

Thus, according to one first variant, resilient layer 18 of constant rigidity (E-modulus) may be applied over all the length of surface 22 contacted by web 12 whose thickness increases from the middle toward the edge proportionally to the global deflection of base body 14. In order to obtain a cylindrical outer contour of load-free roller or reel spool 10, the marginal area of base body 14 (which may be a metal tube, for example) having a conical or parabolic shape.

According to a second variant, a resilient layer 18 of constant thickness all over the length of surface 11, contacted by winding material web 12, and having a rigidity that lessens from the center of roller 10 toward the edge thereof proportionally to the global deflection of reel spool 10, may be applied, while base body 14 may be cylindrical.

In principle, a combination of the aforesaid variants is also possible, for example. Implementation of the first variant is, in particular, possible through a rubber-elastic layer 18 applied in the marginal zones within a rubber coat. The material properties of layer 18 are then preferably determined by the requirement of level surface line 30, which should be as horizontal as possible.

Implementation of the second variant would require a variable E-modulus over the width of paper web 12, if embodied as resilient layer 18. A more easily implemented possibility would, for example, be to use discrete elastic elements or spring elements 20, which would, for example, provide the necessary variability of bedding rigidity by varying the spacing between elements 20 and/or by varying the rigidity of individual elements 20. In order to achieve equalization of roller or reel spool surface 22, an outer tube 28 may be pulled over core 14 (wall thickness 5 to 10 millimeters if made of metal, for example). Such outer tube 28 would have to be taken into account when calculating the dimensions of spring elements 20. It is, however, not to be equated with the deflection-stressed load-bearing tubes of state-of-the-art conventional reel spools. Spring elements 20 can be formed as rubber-elastic ring-shaped bodies, for example, or can be implemented as metal spring packets placed around circumferential surface 22. Pre-stressing elements 20 is another possibility.

Especially in connection with the aforementioned first variant of constant rigidity or constant E-modulus (FIG. 6, for example), the material parameters may be determined or established at least approximately as shown by the following example:

Resilient layer 18 may, in particular, be modeled as a homogenous layer (e.g., marginal thickness, 20 mm; thickness near the middle of the reel spool, 5 mm; length, about 3000 mm) with an E-modulus of about 1 $N/mm^2$. This size represents a lower limit of elasticity of polymer materials (E-modulus between 1 and 500 $N/mm^2$). A rubber coating may serve as a protective layer or tube 28 for resilient layer 18.

Calculations indicate that, in this case, in spite of a clearly greater overall deflection of base body 14, the difference in the excursion of surface 22 of rubber coat or tube 28, contacted by winding material web 12, between the margin and mid-area has significantly decreased. The greater overall deflection of base body 14 results, on the one hand, from a reduction in the thickness of the wall of inner body 14 formed, e.g., by a metal tube in the marginal areas (i.e., conical shape, from, e.g., 40 to, e.g., 20 mm), and on the other hand, from an equalization of paper pressure at surface 22 contacted by winding material web 12 (compare FIG. 7).

Figure 7:
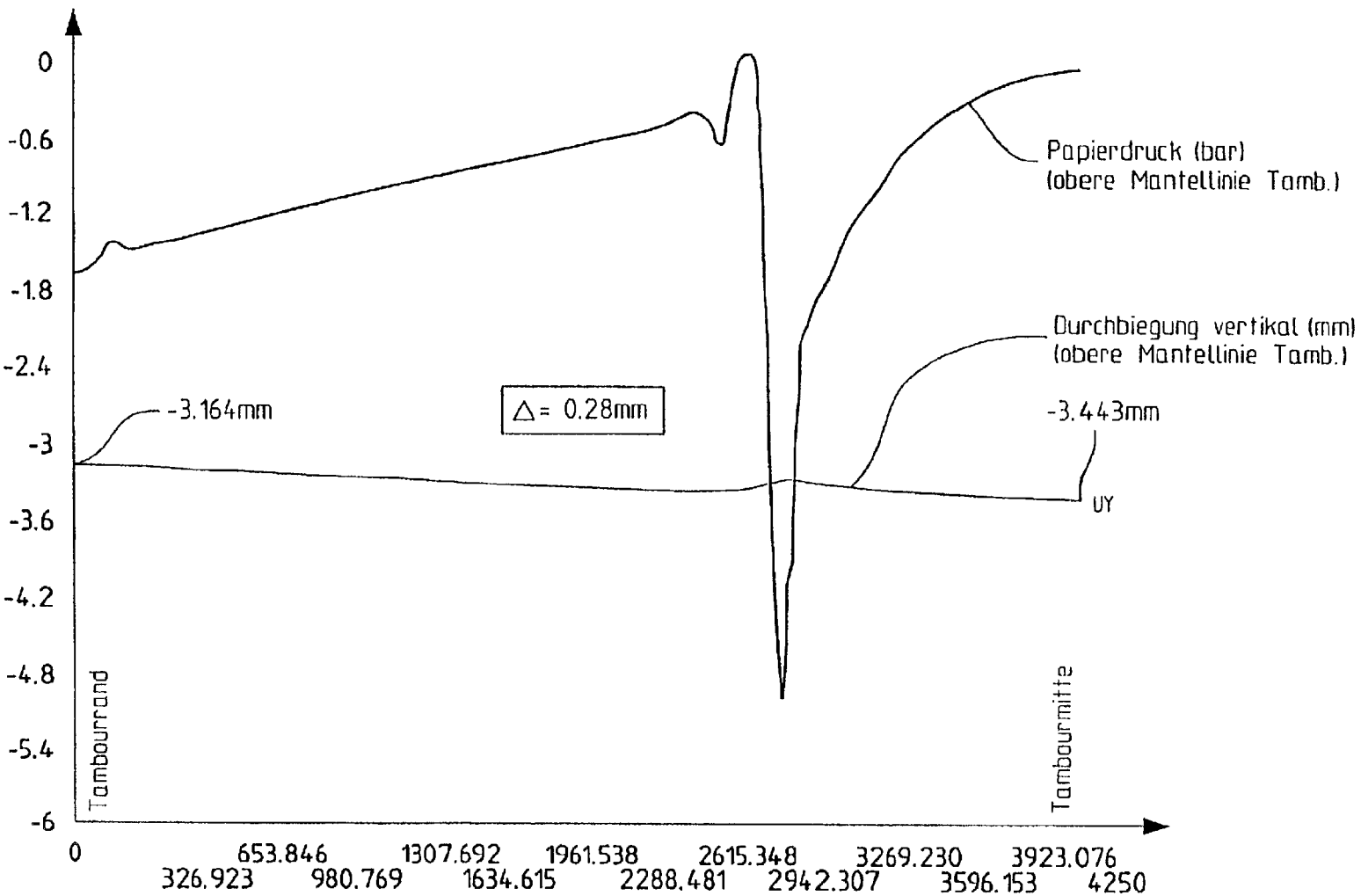
FIG. 7 is a typical representation of paper pressure over the length of the upper surface line of the roller or reel spool, along the roller, starting from the edge toward the middle of the reel spool, together with a typical representation of the vertical deflection of the reel spool's upper surface line.

As is evident from FIG. 7, only the sudden end of resilient layer 18 at this point causes a pressure peak here. An optimization of this transition is to be desired. For a complete compensation of the global deflection of base body 14, its contour would have to be parabolic. It can also be seen that the material is a little too rigid at the assumed 1 N/mm and layer densities. This would have to be compensated by further thickening resilient layer 18 in its marginal areas, or by an even lower E-modulus of the material. In practice, the following particular requirements would have to be met by the material of resilient layer 18:

- it must be highly elastic, even after $10^8$ load changes, for example;
- little fulling/deformation work, even if greatly deformed in each rotation;
- temperature resistance up to the temperature generated by the deformation work; and
- inexpensive production and simple application onto the tube.

If the qualities required for functionality cannot be found in one homogenous material, a non-homogenous material, e.g. with ribs and cavities, or a foamed material would have to be used. The continuation of such an exemplary approach at a solution would lead directly back to the aforementioned second embodiment sample, in which case the variable transversal rigidity could, for example, be realized by use of individual annularly arranged spring elements 20 of variable rigidity.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A roller for winding of a material web thereon, said roller having two roller ends and a mid-roller area, said roller having a maximum winding diameter associated therewith, said roller comprising: a base body being substantially cylindrical; at least one rigid support ring into which said base body is inserted; at least one resilient member, said at least one resilient member being at least one of a resilient layer applied to at least sections of said body or at least one resilient element positioned on said base body, said at least one resilient member being positioned and configured so as to make said roller radially more resilient near each of said roller ends than in said mid-roller area in order to at least partially compensate for a deflection of said base body at the maximum winding diameter, said roller has a roller length, each said resilient member having a radial rigidity, said radial rigidity of each said resilient member varying over said roller length; and a circumferential surface positioned over said base body, said circumferential surface contacting the material web, said circumferential surface in contact with said at least one rigid support ring, said circumferential surface being one of integral with or separate from said at least one resilient member.

2. The roller of claim 1, wherein said material web is a paper web.

3. The roller of claim 1, wherein said at least one rigid support ring is surrounded by said circumferential surface, said circumferential surface being radially less resilient in a vicinity of each said rigid support ring than near said two roller ends.

4. The roller of claim 1, wherein said at least one rigid support ring comprises a plurality of axially-distanced rigid support rings.

5. The roller of claim 1, wherein at least one said rigid support ring at least in part constitutes a portion of said base body.

6. The roller of claim 1, wherein said circumferential surface comprises a resilient tube surrounding said base body, said at least one resilient member being positioned radially between said base body and said resilient tube.

7. The roller of claim 6, wherein said resilient tube comprises a coating of one of rubber and another elastomeric material.

8. The roller of claim 1, wherein said at least one resilient member is a said resilient layer, said resilient layer being a layer comprised of one of rubber an another elastomeric material.

9. The roller of claim 1, wherein said at least one resilient member is a said resilient layer, said resilient layer being formed of a non-homogeneous layer of at least one of a foamed material and a honeycomb structure.

10. The roller of claim 1, wherein said circumferential surface comprises a resilient tube surrounding said base body, said at least one resilient member being a said resilient layer, said resilient layer being provided near said two roller ends and being positioned between said base body and said resilient tube.

11. The roller of claim 10, wherein said resilient layer is a layer comprised of one of rubber and another elastomeric material, said resilient tube being comprised of a coating of one of rubber and another elastomeric material.

12. The roller of claim 1, wherein said at least one resilient member is a said resilient layer, said resilient layer having a constant thickness over an axial length thereof, said resilient layer increasing in radial resilience toward each of said two roller ends, said resilient layer being applied on said base body at least near each of said two roller ends.

13. The roller of claim 1, wherein said at least one resilient member is a plurality of said resilient elements, said roller having a roller axis, said resilient elements being axially distanced from one another at a respective axial spacing relative to said roller axis, each said resilient member having a respective resilience, at least one of said respective axial spacing being appropriately chosen and said respective resilience varying appropriately in order to render said circumferential surface comparatively more resilient near said two roller ends than in said mid-roller area.

14. The roller of claim 1, wherein said at least one resilient member is a plurality of said resilient elements, each said resilient element at least partially comprising one discrete spring element.

15. The roller of claim 14, wherein said each said resilient element at least partially comprises one annular body formed of one of rubber or another elastomeric material.

16. The roller of claim 14, wherein said each said resilient element at least partially comprises a spring packet, said base body having a body circumference, each said spring packet extending over said body circumference.

17. The roller of claim 1, wherein said at least one resilient member comprises at least one said resilient element, said at least one said resilient element being at least partially pre-stressed.

18. The roller of claim 1, wherein said base body is hollow.

19. The roller of claim 1, further including a plurality of tension anchors, said tension anchors being substantially symmetrically arranged, said at least one resilient member comprises a said resilient layer, said tension anchors being at least one of positioned on said base body in an area of said resilient layer applied at least on sections of said base body and at least on said resilient elements arranged on said body.

20. The roller of claim 19, wherein said base body has a body axis, said tension anchors being arranged one of parallel and approximately parallel to said body axis.

21. The roller of claim 19, wherein said tension anchors are arranged at least one of in a traverse diagonal manner and in a spiral manner relative to said base body.

22. The roller of claim 19, further comprising at least two outer walls, each said outer wall being associated a distal end portion of said resilient layer, said tension anchors being braced to a front of said roller via at least two said outer walls.

23. The roller of claim 22, wherein said tension anchors are braced in one of a diagonal manner and a rectangular manner.

24. The roller of claim 19, further comprising at least one spacer operatively positioned between said base body and said circumferential surface, said tension anchors being held in position in a radial direction of said roller by at least one said spacer.

* * * * *